United States Patent [19]

Courtney et al.

[11] 4,003,650

[45] Jan. 18, 1977

[54] CONTROLLER FOR REPRODUCTION APPARATUS

[75] Inventors: John E. Courtney, Fairport; Charles J. Urso, Webster; Charles D. Wilson, Pittsford, all of N.Y.

[73] Assignee: Xerox Corporation, Stamford, Conn.

[22] Filed: Nov. 5, 1974

[21] Appl. No.: 521,102

[52] U.S. Cl. ..... 355/14; 118/647; 355/3 DD

[51] Int. Cl.[2] ..... G03G 15/00

[58] Field of Search ..... 355/3 DD, 14, 17; 118/637

[56] References Cited

UNITED STATES PATENTS

| | | | |
|---|---|---|---|
| 3,674,353 | 7/1972 | Trachtenberg | 355/3 DD |
| 3,674,532 | 7/1972 | Morse | 355/3 DD X |
| 3,788,739 | 1/1974 | Coriale | 355/17 |

*Primary Examiner*—Fred L. Braun

[57] ABSTRACT

A copier or reproduction machine of the type having a photoconductive plate, corona generating means to charge the plate in preparation for imaging thereof, exposure means to expose the charged plate to a light image of the original being copied, developer means to apply developing material to the electrostatic image, and transfer means for transferring the developed image to a support material, i.e., a copy sheet.

To enable the electrostatic development field between the photoconductive plate and the developer section to be controlled and thereby enhance development, an automatic potential controller, which includes an electrometer, is provided. The electrometer includes a probe section arranged to sense voltages on the plate, the electrometer serving to provide a signal reflecting plate potentials. The electrometer signal is used by the controller to automatically adjust the electrostatic development field, as by controlling the voltage bias applied to the developer. The electrometer includes its own internal power supply for the electrometer components, and circuit means are provided to utilize the internal power supply, regulated by the controller itself in response to changes in the electrostatic development field, as the source of bias for the developer and for the electrometer itself thereby obviating the need for separate and duplicate power supplies.

4 Claims, 8 Drawing Figures

CONTROLLER FOR REPRODUCTION APPARATUS

This invention relates to an improved reproduction machine with electrometer controlled electrostatic development field, and more particularly, to a reproduction machine with electrometer in which the power supply for electrometer and the development field component controlled by the electrometer are one and the same.

As will be readily understood by those familiar with copiers, the efficacy of electrostatic type copiers depends upon the proper relative charge being maintained between the photoconductive member and the developing means. For, as appreciated, this charge relationship or electrostatic development field is relied upon to attract the developing material, i.e. toner, from the supply source to the photoconductive member in conformance with both the outline and density of the electrostatic image on the photoconductive member. The electrostatic image which undergoes this development may be formed through the expediency of exposing the previously charged photoconductive member to a light image of the original being copied.

One method of sustaining the proper charge relationship between the photoconductive member and the developing means is to use a potential sensor, commonly called on electrometer, to sense potentials on the photoconductive member at some appropriate point. This device can be used as a service instrument to provide, by meter, a visible indication of the photoreceptor charge condition from which the electrostatic development field can be manually adjusted. In other cases, a feedback loop may be provided to enable the electrometer to automatically control the development field. Control over the electrostatic development field may be done, for example, by controlling or regulating the developer bias, or by controlling potentials on the photoconductor itself by regulating the corona charging means or the copier exposure means.

The copier or reproduction machine itself incorporates power sources to provide the requisite electrical power to the various operating components thereof. These include those copier components responsible for development of the latent electrostatic images on the photoconductive member. However, the copier power supplies are normally buried within the copier rendering servicing and repair difficult. In addition, for purposes of economy, one copier power supply may serve several components so that failure in one portion of the power supply may require difficult and expensive replacement or repair of the entire power supply for the copier.

It is a principal object of the present invention to provide a new and improved reproduction machine.

It is an object of the present invention to provide a copier in which the source of bias for the copier developer comprises the controlling electrometer.

It is a further object of the present invention to provide an automatic potential controller for copiers in which the power supplies for the controller and the copier component being controlled are integral.

It is an object of the present invention to provide an improved controller for use with copiers adapted to serve both as an electrometer and as a source of bias for the copier developing system.

It is another object of the present invention to provide a reproduction machine with an electrometer controller adapted to automatically regulate the machine electrostatic development field in response to changes in operating potential of the reproduction machine photoreceptor in which the development field component regulated comprises the electrometer's own power supply.

It is another object of the present invention to provide an improved electrometer controller for controlling bias on the magnetic brush type developing means of a reproduction machine in which the controller serves both as a source of developing means bias and the control element therefor.

This invention relates to an apparatus for controlling the electrostatic development field of a reproduction machine to enhance development of the latent electrostatic images on the reproduction machine photoconductive member, comprising in combination, means for charging the photoconductive member in preparation for imaging; means for exposing the charged member to provide a latent electrostatic image of the original being copied; means to develop the latent electrostatic image in preparation for transfer; a potential controller including a probe section operatively arranged adjacent the photoconductive member to sense potentials on the member and a control section for controlling the electrostatic development field in response to changes in potential on the photoconductive member as sensed by the probe section, the controller having an internal power source for driving the controller; means operatively coupling the controller power source with at least one of the machine charging, exposing or developing means in the reproduction machine whereby to supply voltages from the controller's own power source to the reproduction machine one means; and circuit means for controlling the controller power source in response to changes in potential on the photoconductive member to provide a controlled output to the reproduction machine one means whereby to control the electrostatic development field.

Other objects and advantages of the present invention will be apparent from the ensuing description and drawings in which.

Figure 1:
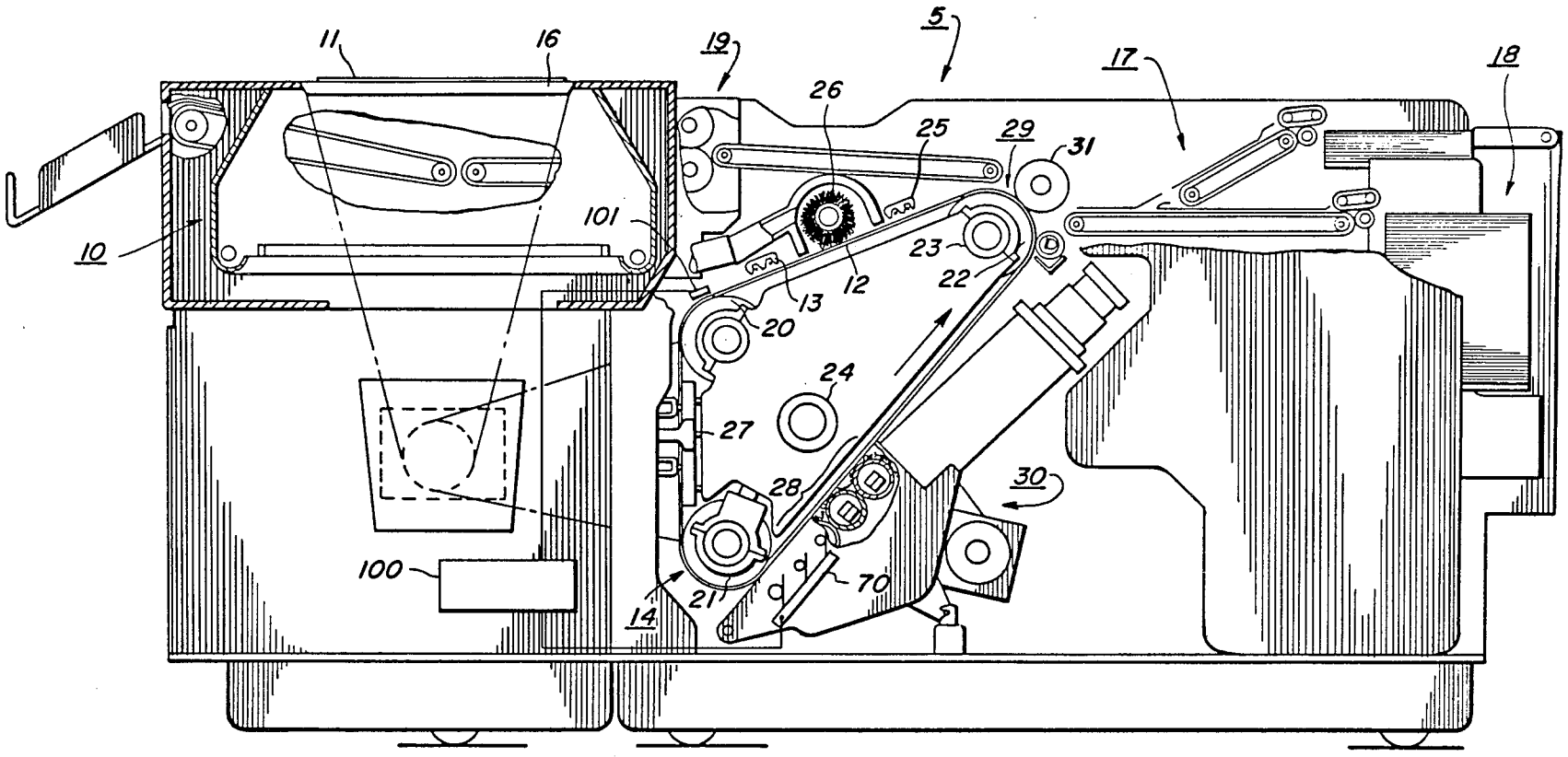
FIG. 1 is a schematic sectional view of an electrostatic reproduction machine having the automatic potential controller of the present invention.

For a general understanding of the illustrated copier/reproduction machine in which the invention may be incorporated, reference is had to FIG. 1 in which an exemplary reproduction or copying machine, designated generally by the numeral 5, and incorporating the automatic potential controller 100 of the present invention, is illustrated.

A document 11 to be copied is placed upon a transparent support platen 16 fixedly arranged in an illumination assembly, generally indicated by the reference numeral 10, positioned at the left end of the machine 5. Light rays from an illumination system are flashed upon the document to produce image rays corresponding to the informational areas. The image rays are projected by means of an optical system onto the photosensitive surface of a xerographic plate in the form of a flexible photoconductive belt 12 arranged on a belt assembly, generally indicated by the reference numeral 14.

The belt 12 comprises a photoconductive layer of selenium which is the light receiving surface and imaging medium for the apparatus, on a conductive backing. The surface of the photoconductive belt is made photosensitive by a previous step of uniformly charging the same by means of a corona generating device or corotron 13.

The belt is journaled for continuous movement upon three rollers 20, 21 and 22 positioned with their axes in parallel. The photoconductive belt assembly 14 is slidably mounted upon two support shafts 23 and 24, with the roller 22 rotatably supported on the shaft 23 which is secured to the frame of the apparatus and is rotatably driven by a suitable motor and drive assembly (not shown) in the direction of the arrow at a constant rate. During exposure of the belt 12, the reflected light image of such original document positioned on the platen is flashed on the surface of the belt to produce an electrostatic latent image thereon at exposure station 27.

As the belt surface continues its movement, the electrostatic image passes through a developing station 28 in which there is positioned a magnetic brush developing apparatus, generally indicated by the reference numeral 30, and which provides development of the electrostatic image by means of multiple brushes as the same moves through the development zone, as more fully hereinafter described.

The developed electrostatic image is transported by the belt to a transfer station 29 whereat a sheet of copy paper or transfer member is moved between a transfer roller 31 and the belt at a speed in synchronism with the moving belt in order to accomplish transfer of the developed image solely by an electrical bias on the transfer roller. There is provided at this station a sheet transport mechanism, generally indicated at 17, adapted to transport sheets of paper from a paper handling mechanism, generally indicated by the reference numeral 18, to the developed image on the belt at the station 29.

After the sheet is stripped from the belt 12, it is conveyed into a fuser assembly, generally indicated by the reference numeral 19, wherein the developed and transferred xerographic powder image on the sheet material is permanently affixed thereto. After fusing, the finished copy is discharged from the apparatus at a suitable point for collection externally of the apparatus. The toner particles remaining as residue on the developed image, background particles and those particles otherwise not transferred are carried by the belt 12 to a cleaning apparatus 26 positioned on the rim of the belt between rollers 20 and 22 adjacent a charge device 25. Further details regarding the structure of the belt assembly 14 and its relationship with the machine and support therefor may be found in application Ser. No. 102,312, filed Dec. 29, 1970, now U.S. Pat. No. 3,730,623, issued Jan. 5, 1973, and assigned to the same assignee.

Figure 3:
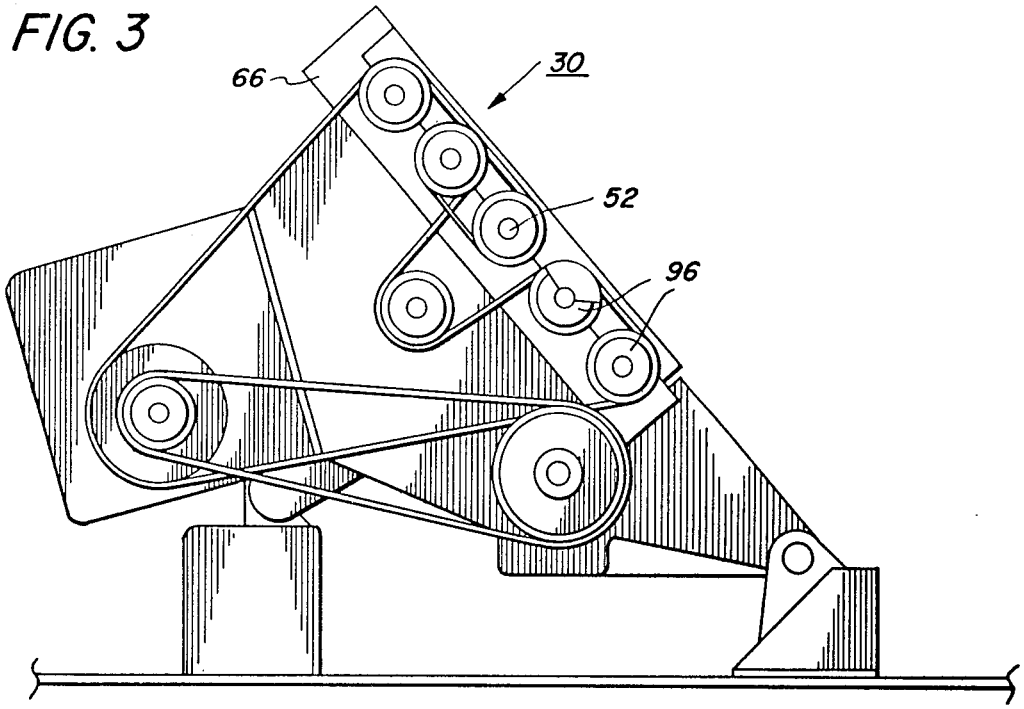
FIG. 3 is an elevational view of the opposite side of the magnetic brush developing assembly illustrating the drive mechanism for the magnetic brush roller apparatus.
Figure 2:
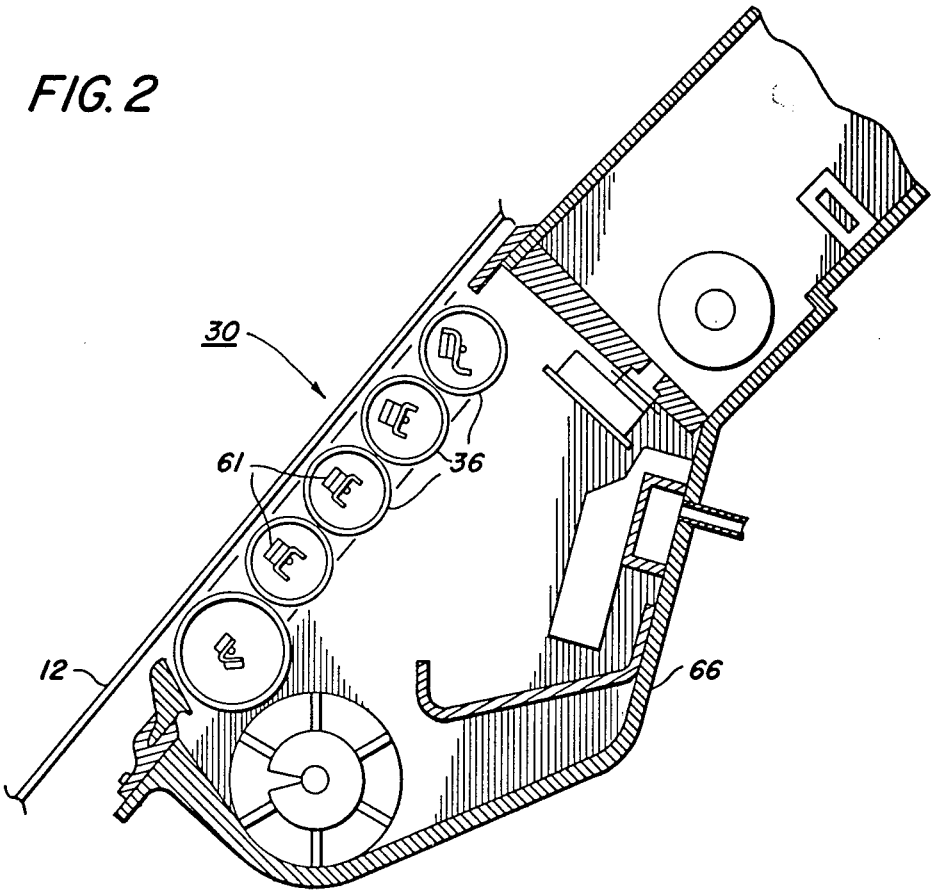
FIG. 2 is a side view of the magnetic brush developing apparatus shown in FIG. 1.
Figure 4:
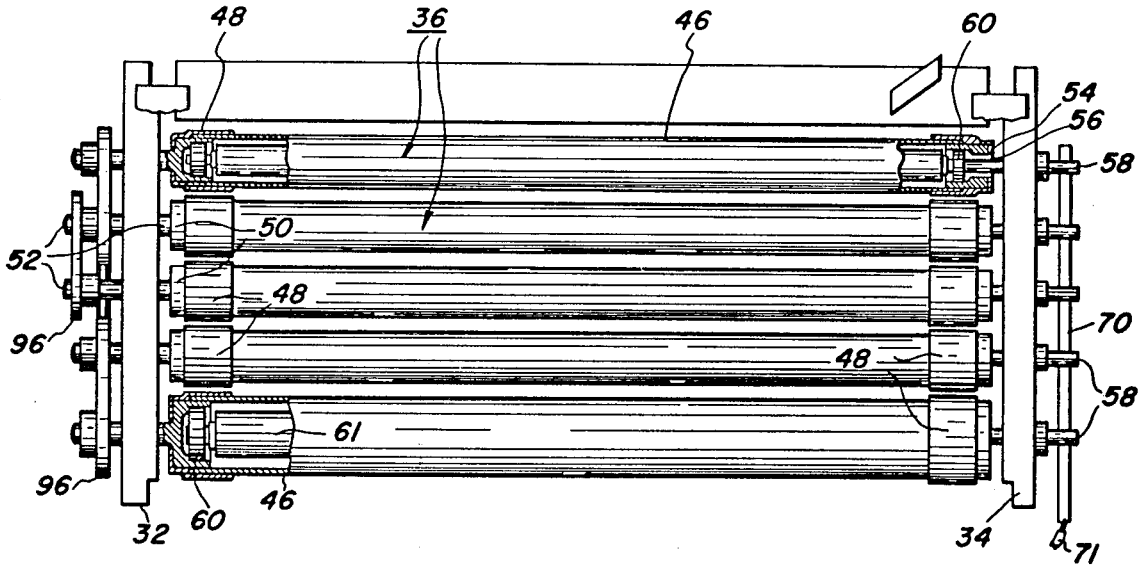
FIG. 4 is a top plane view of the magnetic brush assembly showing details of the brush bias applying mechanism.

Referring to FIGS. 2 through 4, there is illustrated a magnetic brush developing assembly, generally indicated as 30, comprising a series of rollers 36 rotatably supported in frame end plates 32, 34. The rollers 36 are comprised of a cylindrical sleeve 46 of a roughened surface formed of a non-magnetizable material and extending almost the length of the housing of the developing apparatus 15. End sleeves 48, formed of an insulating material, are shrunk fit on the cylindrical sleeve 46 adjacent the ends thereof. One end of the sleeve 46 is closed by a cap 50 which supports a roller drive shaft 52 in coaxial alignment with the sleeve 46. The other end of the sleeve 46 is closed by a cap 54 having an orifice 56 through which extends shaft 58 of the internal bar magnets 61. Suitable bearing means 60 are provided to permit the sleeve 46 to rotate relative to shaft 58.

The roller drive shafts 52 are suitably mounted in bearings in end plate 32 and carry on their projecting ends drive sprockets 96. Sprockets 96 are formed of an insulating material.

Referring specifically to FIGS. 2 and 3, the magnet roller assembly 30 is disposed within a housing, generally indicated as 66, having a generally rectangular cross section and a length extending beyond the width of the photoconductive belt 12. Housing 66 is substantially closed except for an opening opposite photoconductive belt 12 whereat development of the latent image on belt 12 is effected. Housing 66 in effect serves as a container for developing material comprising carrier beads from magnetizable material and colored electrostatic toner particles which adhere thereto.

To provide bias to magnetic brush rollers 36, a suitable wiper 70 is provided in electrical contact with magnet shafts 58, wiper 70 extending along and being supported by side plate 34 to form an electrical path from the power supply section 113 of the automatic potential controller 100 to each of the roller sleeves 46. Line 71 interconnects wiper 70 with controller 100. During development, the rollers 36 are rotated in unison in the same direction from a suitable drive source via sprockets 96, the internal bar magnets 61 remaining stationary. The brush bristles produced by the influence of the magnetic field emanating from the bar magnets 61 acting upon the magnetizable carrier beads in the developing material will form on the upper region of the roller sleeves 46 adjacent the undersurface of the selenium belt 12.

This takes the form of a "magnetic blanket" extending continuously from one brush roller 36 to another for the entire width of the development zone 28 wherein the material is disposed or available to some degree for developing purposes. Further details regarding the formation and effect of the "magnetic blanket" are described in application Ser. No. 830,285, filed June 4, 1969, now U.S. Pat. No. 3,640,248, issued Feb. 8, 1972 and assigned to the same assignee.

Figure 5:
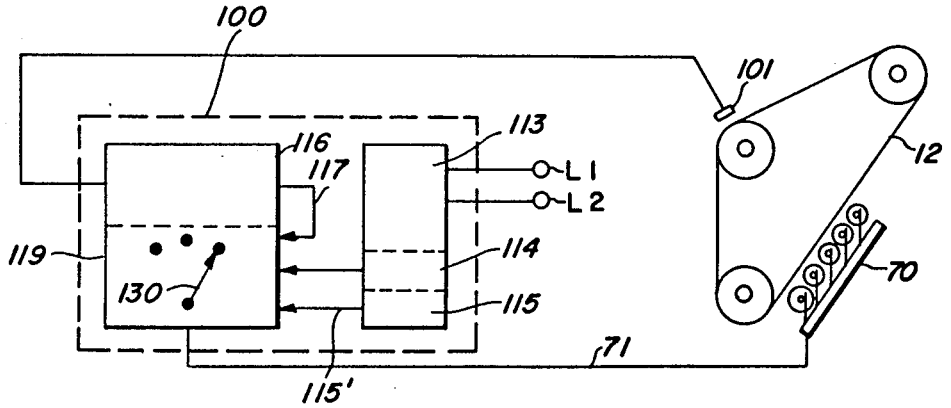
FIG. 5 is a schematic view of the automatic potential controller of the present invention in combination with the reproduction machine of FIG. 1.
Figure 6:
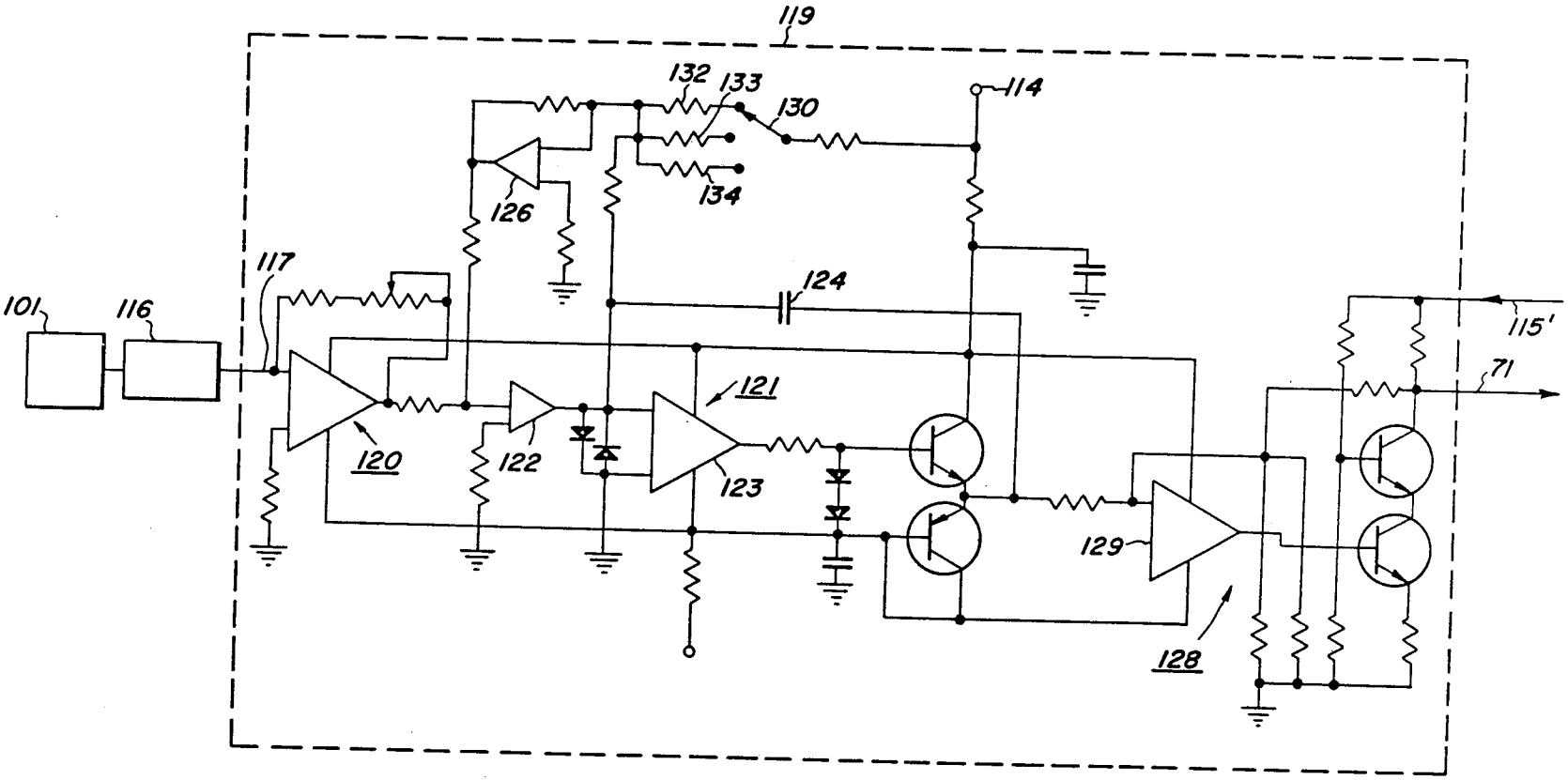
FIG. 6 is a schematic view of the interface circuit of the automatic potential controller shown in FIG. 5.

Referring to FIGS. 1, 5, and 6, controller 100 includes an electrometer 116 having a suitable probe 101 for sensing potentials on photoconductor 12. In the exemplary arrangement shown, probe 101 is mounted adjacent to and in operative relationship with belt 12 at a point between the corona charging device 13 and exposure station 27. Probe 101, which may conveniently be positioned midstream of belt 12, senses potential on the photoconductive surface of belt 12 after belt 12 is charged but before exposure, it being understood that exposure results in selective discharge of belt 12. Circuit 119 interfaces the electrometer 116 with copier 10 as will appear.

Electrometer 116 is designed to provide an output signal reflecting belt potentials, electrometer 116 having an internal power supply 113 for operating the electrometer components. The electrometer power supply 113 normally includes a suitable rectifier section designed to convert the alternating current input from line L1 L2 into direct current. The electrometer power supply 113 may be divided into a low voltage section, represented schematically by numeral 114, and a high voltage section, represented schematically by numeral 115.

Referring particularly to FIG. 6, interface circuit 119 includes a suitable operational amplifier circuit 120 for converting the relatively high signal 117 from the electrometer 116 to a proper level for a suitable summing circuit 122. The output of summing circuit 122 is fed to integrator circuit 121 which includes an operational amplifier 123 and feedback or signal storage capacitor 124. Circuit 122 matches, i.e., sums, the electrometer signal from amplifier circuit 120 with a predetermined reference potential from operational amplifier 126 as reflected by the setting of bias control switch 130. The source of voltage for such reference potential comprises low voltage power supply section 114. The resulting low voltage signal output of integrator circuit 121 is fed to high voltage operational amplifier circuit 128.

A voltage tap 115' is taken from the high voltage section 115 of the electrometer power supply 113. Circuit 128, which includes operational amplifier 129, serves to control the biasing voltage applied from the electrometer high voltage section 115 to magnetic brush rollers 36 of developer section 28 in response to the control signal from integrator circuit 121. The controlled output of circuit 128 passes via line 71 to wiper 70 to provide the requisite operating bias to the magnetic brush roller sleeves 46.

Bias control switch 130 permits the bias level on the developer rollers 36 to be pre-set. Switch 130 is used to change the resistance in the biasing circuit to amplifier 126 to thereby vary the reference potential applied thereto. The low voltage section 114 of power source 113 is utilized to provide the aforesaid bias to amplifier 126. For this purpose, resistors 132, 133, 134 are provided for selective insertion into the amplifier biasing circuit by control switch 130.

As will be understood by those skilled in the art, development of the latent electrostatic image formed on belt 12 is dependent upon the voltage differential between the latent image and the developing means. This voltage differential, which may be described as the xerographic development field, serves to attract toner to the latent electrostatic image in accordance with image outline and density requirements to faithfully reproduce the original being copied. The strength and makeup of the xerographic development field may be adjusted, for example, by raising or lowering the voltage charge comprising the image and non-image areas which may be done by varying the power to corona charging device 13. Alternately, the voltage bias applied to magnetic brushes 36 can be changed, or in the case of an electroded development system, the voltage bias applied to the development electrode or electrodes.

Figure 7:
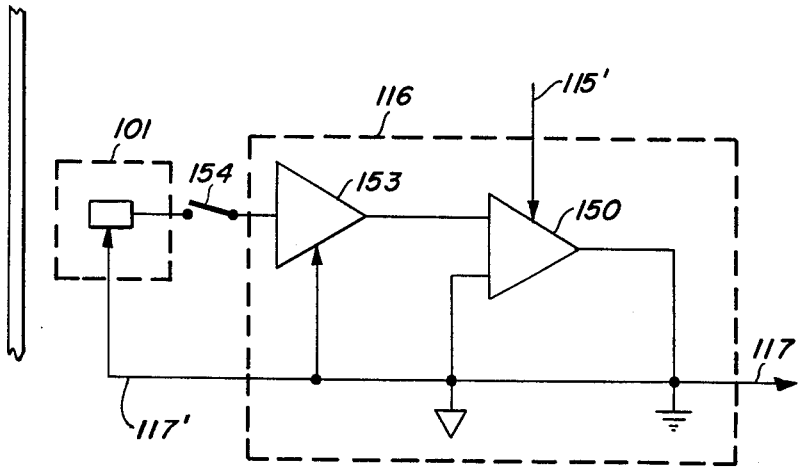
FIG. 7 is a schematic view of the controller internal bias circuit.
Figure 8:
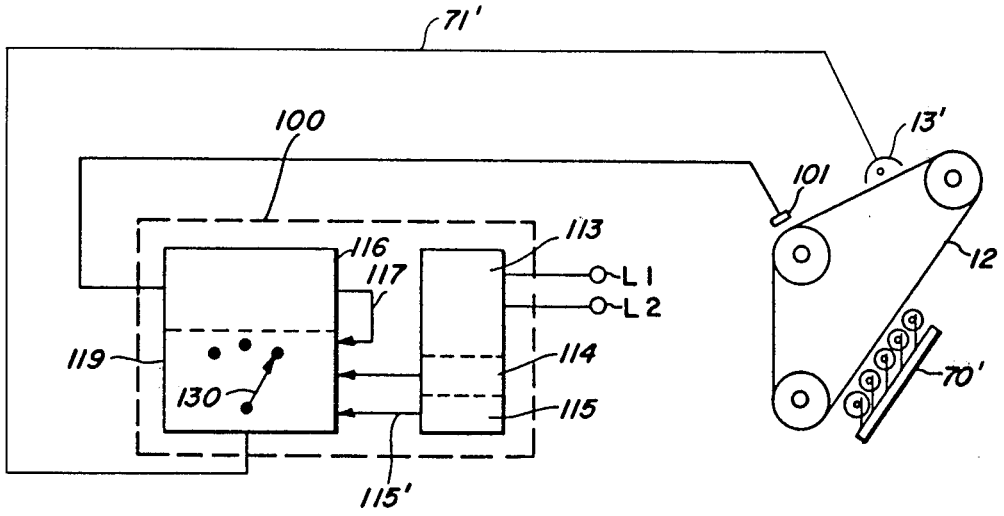
FIG. 8 is a schematic view of an alternate embodiment with the charge corotron regulated by the automatic potential controller of the present invention.

The internal biasing voltage of electrometer 116 and probe 101, which is derived from the electrometer's power supply 115 is similarly regulated in accordance with the condition of photosensitive member 12 as sensed by probe 101. Referring particularly to FIGS. 5 and 7 of the drawings, the internal operating circuit of electrometer 116 includes a control section such as operational amplifier 150 for regulating output of the high voltage power supply 115 inputted thereto from the high voltage tap 115'. The control gate of amplifier 150 is connected to probe 101 via a suitable signal amplifier circuit 153 and sample and hold switch 154. The regulated voltage output of amplifier 150 is inputted via line 117' to both probe signal amplifier circuit 153 and probe 101 to null field effects between probe 101 and the photosensitive member 12.

Sample and hold switch 154 permits probe readings and hence adjustment of the bias to the reproduction machine element being controlled, i.e., magnetic brushes 36, and to the bias imposed on probe 101 to be periodically adjusted. Where constant adjustment of these biases is desired, switch 154 is retained in a closed position.

As described earlier, controller 100 serves as both the source and control for bias to itself and to magnetic brushes 36 in response to voltage conditions on belt 12, and in this way controls the xerographic development field as described earlier. Alternately, control may be exercised through corona charging device 13, and in that circumstance the high voltage section 115 of electrometer 100, the output of which may be suitably modified to provide requisite operating voltage levels to corona charging device 13 and which is controlled by controller 100 in response to the charge condition of belt 12, serves as the power source for charging device 13.

While the invention has been described with reference to the structure disclosed, it is not confined to the details set forth, but is intended to cover such modifications or changes as may come within the scope of the following claims.

What is claimed is:

1. In an apparatus for controlling the electrostatic development field in a reproduction machine to enhance development of the latent electrostatic images on the photoconductive member of said reproduction machine, the reproduction machine including as components contributing to said electrostatic development field, charging means for charging the photoconductive member in preparation for imaging, exposing means for exposing the charged photoconductive member to provide a latent electrostatic image of the original on the member, and developing means for developing the image, the combination of a potential controller including a probe operatively arranged adjacent said photoconductive member to sense potentials on said member and a control section adapted to control a power source for biasing at least one of said reproduction machine components in response to changes in potential on said photoconductive member as sensed by said probe; said probe producing a signal indicative of the potential on said photoconductive member, said controller having an internal power source for driving said controller;

a first circuit means operatively coupling said controller power source with at least one of said reproduction machine components whereby the controller's own power source serves as the source of power for said one component and for said controller;

said control section including a first control for regulating power input from said controller power source to said first circuit means in response to the signal from said probe whereby to vary bias to said one component in accordance with changes in said photoconductive member potentials; and a second circuit means operatively coupling said controller power source with said probe whereby to bias said probe and neutralize probe spacing effects, said control section including a second control for regulating power input from said controller power source to said second circuit means in response to the signal from said probe whereby to vary bias to said probe in accordance with changes in said photoconductive member potentials, said controller including means to enable the potential control point of said controller to be selected, said control section providing control signals reflecting the relationship between the potential control point selected and the potential sensed by said probe for each of said first and second controls.

2. The apparatus according to claim 1 including switch means to interrupt the signal from said probe.

3. The apparatus according to claim 1 in which said reproduction machine charging means includes a corona generator for charging said member in preparation for imaging, said first circuit means coupling said controller power source with said corona generator whereby to charge said photoconductive member in accordance with changes in potential on said photoconductive member.

4. The apparatus according to claim 1 in which said reproduction machine developing means includes at least one magnetic brush;

said first circuit means coupling said controller power source with said magnetic brush whereby to bias said brush in accordance with changes in potential on said photoconductive member.

* * * * *